US005582560A

United States Patent [19]

Magnuson

[11] Patent Number: 5,582,560

[45] Date of Patent: Dec. 10, 1996

[54] JAW EXERCISER

[76] Inventor: Gerald L. Magnuson, 7700 Penn Ave. S. #234, Minneapolis, Minn. 55423

[21] Appl. No.: 309,809

[22] Filed: Sep. 21, 1994

[51] Int. Cl.[6] ..... A63B 23/03

[52] U.S. Cl. ..... 482/111; 601/38; 128/861

[58] Field of Search ..... 601/38; 482/11, 482/121; 128/859, 861, 862, 777; 74/379.01, 379.02

[56] References Cited

U.S. PATENT DOCUMENTS

| | | | |
|---|---|---|---|
| 2,192,558 | 3/1940 | Poindexter | 128/861 |
| 2,590,118 | 3/1952 | Oddo, Jr. | 128/861 |
| 2,702,032 | 2/1955 | Freedland | 128/861 |
| 2,708,931 | 5/1955 | Freedland | 128/861 |
| 3,126,002 | 3/1964 | Owens | 128/861 |
| 3,295,519 | 1/1967 | Gerber | 601/38 |
| 3,525,520 | 8/1970 | Dwyer | 482/11 |
| 3,528,655 | 9/1970 | Ruderian | 482/11 |
| 3,547,433 | 12/1970 | Robins . | |
| 3,844,286 | 10/1974 | Cowen | 128/861 |
| 3,929,548 | 12/1975 | Shamlian | 128/862 |
| 4,185,817 | 1/1980 | Peterson . | |
| 4,196,902 | 4/1980 | Borriello . | |
| 4,280,696 | 7/1981 | Ramon . | |
| 4,672,959 | 6/1987 | May et al. . | |
| 4,765,324 | 8/1988 | Lake, Jr. . | |
| 5,042,506 | 8/1991 | Liberati | 128/859 |
| 5,082,007 | 1/1992 | Adell . | |
| 5,152,301 | 10/1992 | Kittelsen et al. . | |
| 5,386,821 | 2/1995 | Poterack | 128/859 |

*Primary Examiner*—Richard J. Apley
*Assistant Examiner*—Jeanne M. Clark
*Attorney, Agent, or Firm*—Zarley, McKee, Thomte, Voorhees & Sease; Mark D. Frederiksen

[57] ABSTRACT

A jaw exercising apparatus includes an elongated plate having a pair of bite pads projecting from the rearward surface of opposing ends of the plate. An aperture is formed through the plate intermediate the bite pads so as to permit air flow therethrough. Each bite pad has a pair of upper and lower ridges projecting therefrom generally parallel with the plate with upper and lower biting surfaces extending between the plate and the ridges. Preferably, the entire exercising apparatus is formed as a single integral piece of resilient compressible and stretchable material such as silicone rubber. The biting surfaces of each bite pad are preferably either parallel to one another, or diverging from outward ends towards the center of the exercising apparatus.

3 Claims, 2 Drawing Sheets

JAW EXERCISER

TECHNICAL FIELD

The present invention relates generally to mouthpieces for separating the teeth of the jaw, and more particularly to an improved mouthpiece for strengthening and tightening the muscles of the face and jaws.

BACKGROUND OF THE INVENTION

Various apparatus for exercising the jaw and facial muscles have been known in the art for many years. Typically, these exercisers utilize springs and tension bars to bias various components or have handles and appendages for moving the device in the mouth. For example, U.S. Pat. No. 3,547,433 to Robins discloses a slightly flexible noncompressible arcuate member which is inserted between a lip and underlying gum area for strengthening the facial muscles by selective tensioning and relaxing of the lip over a bulge created in the member. U.S. Pat. No. 4,185,817 to Peterson discloses a teeth exerciser with a U-shaped configuration formed of a yieldable resilient material providing a plate surface for the teeth being exercised. U.S. Pat. No. 4,196,902 to Borriello discloses a crescent shaped piece of resilient material which is inserted between the upper and lower teeth to exercise the facial muscles by overcoming the resistance of the material. Finally, U.S. Pat. No. 4,280,696 to Ramon discloses an exerciser apparatus having a pair of flat spring arms pivotally connected to each other by 360° convolutions of a torque spring. The mouth is exercised by biting on the jaws which are biased away from one another.

While all of the above-described prior art devices provide apparatus for exercising the facial muscles, they have several drawbacks. First, devices which are inserted between the teeth and gum are awkward to manipulate, and do not provide protection against the grinding of the teeth. Mechanical apparatus inserted between the upper and lower teeth are relatively cumbersome to manipulate, and can pinch or catch portions of the mouth during operation. Many prior art devices fill the space between the upper and lower teeth, like mouthguards and the like, but prevent free breathing of the user during the exercise.

In addition, the inventor herein has found that "resistance exercise" is helpful with respect to the oral muscles, if the jaw is properly positioned in its socket. Without this proper positioning, as a person uses or exercises a muscle or muscle group, the muscle is actually losing its strength rather than increasing in strength.

SUMMARY OF THE INVENTION

It is therefore a general object of the present invention to provide an improved jaw exercising apparatus.

It is also an object of the invention to provide a jaw exerciser which properly positions the jaw within its socket to increase the strength of the oral muscles during resistance exercise.

Another object of the present invention is to provide a jaw exercising apparatus which provides free flow of air during exercises.

A further object is to provide a jaw exercise apparatus with a variety of contours to provide a variety of resistance to clenching of the jaw muscles.

Still another object of the present invention is to provide a jaw exercising apparatus which fits entirely within the mouth.

Yet a further object is to provide a jaw exercising apparatus which is economical to manufacture and simple to use.

These and other objects will be apparent to those skilled in the art.

The jaw exercising apparatus of the present invention includes an elongated plate having a pair of bite pads projecting from the rearward surface of opposing ends of the plate. An aperture is formed through the plate intermediate the bite pads so as to permit air flow therethrough. Each bite pad has a pair of upper and lower ridges projecting therefrom generally parallel with the plate with upper and lower biting surfaces extending between the plate and the ridges. Preferably, the entire exercising apparatus is formed as a single integral piece of resilient compressible and stretchable material such as silicone rubber. The biting surfaces of each bite pad are preferably either parallel to one another, or diverging from outward ends towards the center of the exercising apparatus.

DESCRIPTION OF THE PREFERRED EMBODIMENT

Figure 1:
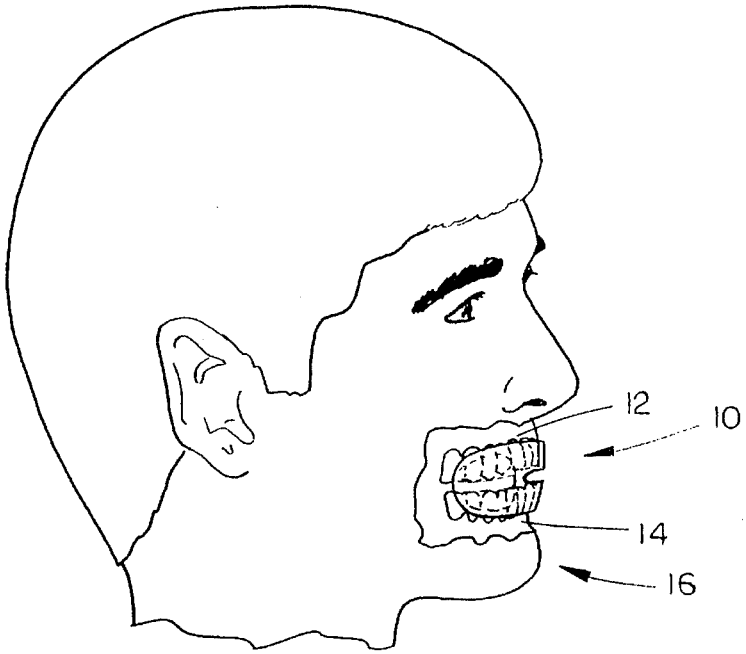
FIG. 1 is a perspective view of a person with the jaw exercise apparatus of the present invention inserted in the mouth.

Referring now to the drawings, in which similar or corresponding parts are identified with the same reference numeral, and more particularly to FIG. 1, the jaw exerciser of the present invention is designated generally at 10 and is shown positioned between the upper and lower teeth 12 and 14 respectively of a person's mouth 16.

Figure 2:
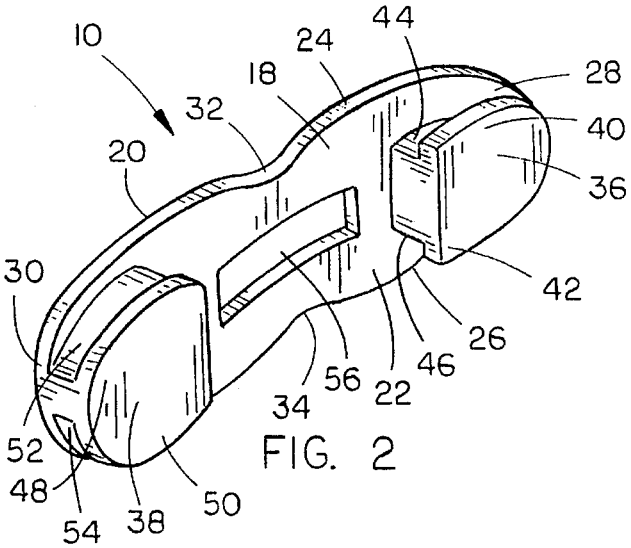
FIG. 2 is a rearward perspective view of the present invention.
Figure 3:
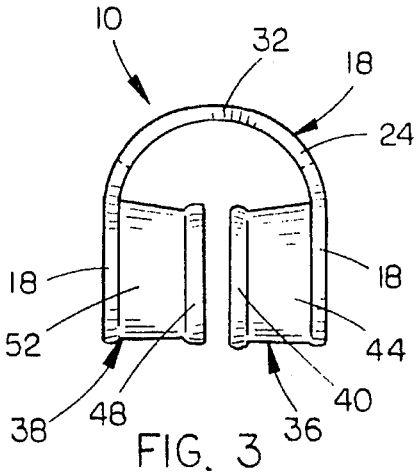
FIG. 3 is a top plan view of the jaw exerciser bent into position for insertion in the mouth.

Referring now to FIG. 2, jaw exerciser 10 includes an elongated plate 18 of a resilient stretchable material such as a silicone rubber compound. Plate 18 has a forward surface 20, a rearward surface 22, an upper edge 24, lower edge 26, right end 28 and left end 30. Preferably, plate 18 is approximately ⅛ inch thick, so as to fit comfortably between the teeth and lips.

The upper and lower edges 24 and 26 of plate 18 have an indentation 32 and 34 respectively formed therein midway between the right and left ends, to receive the upper and lower labial frenulums of the mouth.

Right and left bite pads 36 and 38, respectively, are formed at the right and left ends 28 and 30 on the rearward surface 22 of plate 18, and project rearwardly therefrom.

Right bite pad 36 includes upper and lower ridges 40 and 42 projecting upwardly and downwardly from the rearward surface of bite pad 36, parallel and spaced apart from plate 18. Thus, ridges 40 and 42 form a rearward boundary for upper and lower biting surfaces 44 and 46 of bite pad 36, while plate 18 forms a forward boundary for biting surfaces 44 and 46.

Left bite pad 38 also has upper and lower ridges 48 and 50 forming boundaries for upper and lower biting surfaces 52 and 54 respectively, similar to bite pad 36.

Figure 4:
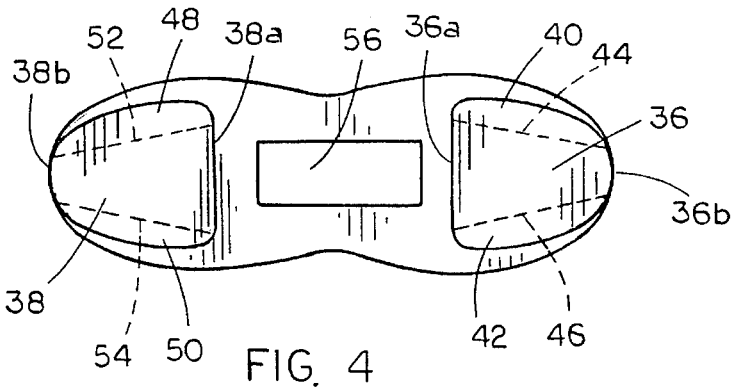
FIG. 4 is a rear elevational view of the jaw exerciser.
Figure 5:
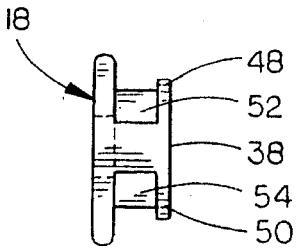
FIG. 5 is an elevational view taken from the left end of FIG. 4.

Referring to FIG. 4, upper and lower biting surfaces 44 and 46 of bite pad 36 taper towards one another from the inward end 36*a* to the outward end 36*b* of bite pad 36. Similarly, upper and lower biting surfaces 52 and 54 of bite pad 38 taper outwardly from inward end 38*a* to outward end 38*b* of bite pad 38. Tapered biting surfaces 52 and 54 are also shown in FIG. 5. Preferably, biting surfaces 44, 46, 52 and 54 have a width, as measured between plate 18 and the respective ridges 40, 42, 48 and 50, of approximately ¼ inch, to receive the upper and lower teeth thereon. Ridges 40, 42, 48 and 50 are preferably about ⅛ inch high and ⅛ inch thick, to provide a boundary to prevent the teeth from slipping the biting surfaces of the bite pads.

Referring once again to FIGS. 2 and 4, an air hole 56 is provided generally centrally through plate 18, between bite pads 36 and 38 and between indentations 32 and 34.

Figure 6:
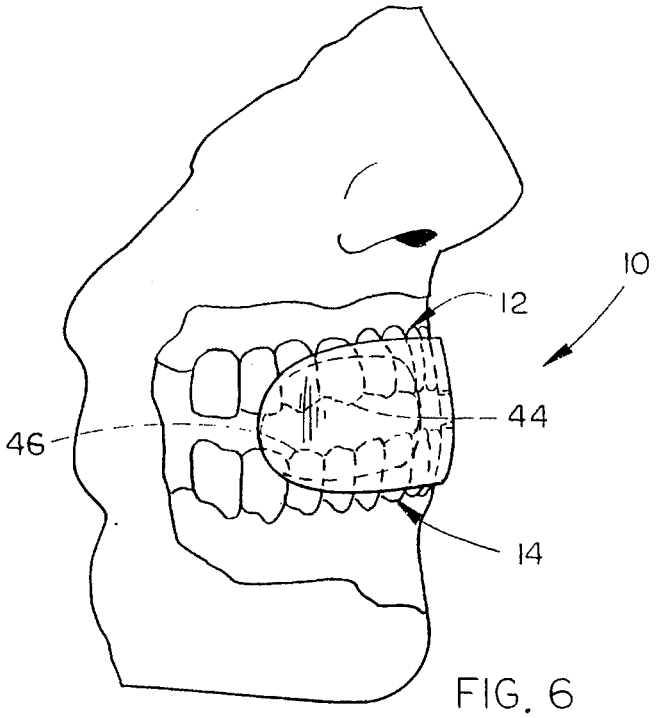
FIG. 6 is an enlarged perspective view of the jaw exerciser of FIG. 2 positioned in the mouth.

As shown in FIG. 6, when jaw exerciser 10 is placed in the mouth, upper and lower teeth 12 and 14 will compress the upper and lower biting surfaces (surfaces 44 and 46 are shown in hidden lines in FIG. 6) as the jaw is clenched during exercises. The resilient compressibility of the material of jaw exerciser 10 not only provides a soft surface which protects against chipping or grinding of the teeth, but also provides a biasing force to resist the clenching motion of the teeth. Thus, the masseter muscles of the mouth are exercised through the repetitive clenching of the jaws and the resistance of exerciser 10. Preferably, the plate 18 and bite pads 36 and 38 are formed as a single integral unit of silicone rubber.

Figure 7:
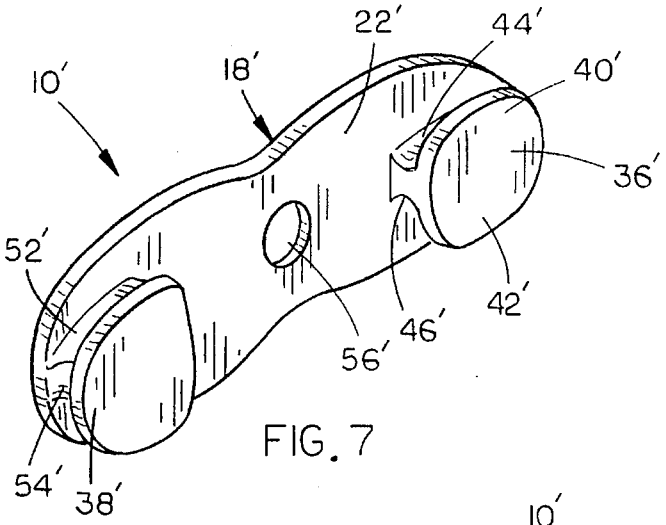
FIG. 7 is a rearward perspective view of a second embodiment of the invention.
Figure 10:
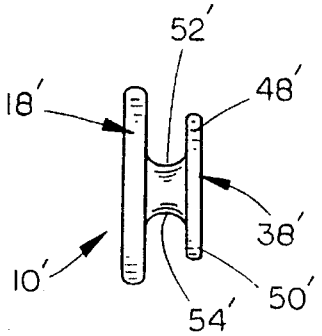
FIG. 10 is an end elevational view of the invention taken from the left end of FIG. 9.

Referring now to FIG. 7, a second embodiment of the jaw exerciser is designated generally at 10' and includes an elongated plate 18' with bite pads 36' and 38', the same as the first embodiment of the invention. However, in the second embodiment, biting surfaces 44' and 46' are parallel to one another and biting surfaces 52' and 54' are parallel to one another, rather than tapered as in the first embodiment. In addition, air hole 56' is preferably a smaller area than air hole 56 of the first embodiment of the invention. As discussed in more detail hereinbelow, the second embodiment of the invention is provided for less strenuous activities, and therefore does not separate the upper and lower teeth of the mouth to as great an extent as the first embodiment of the invention. FIG. 10 also shows that the biting surfaces may be slightly concave between plate 18' and the associated ridges 48' and 50'.

Figure 8:
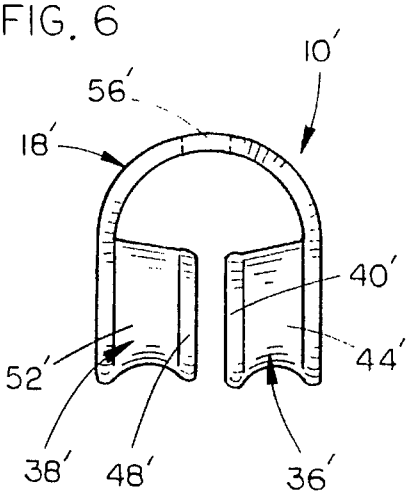
FIG. 8 is a top plan view of the embodiment shown in FIG. 7, positioned for insertion in the mouth.
Figure 9:
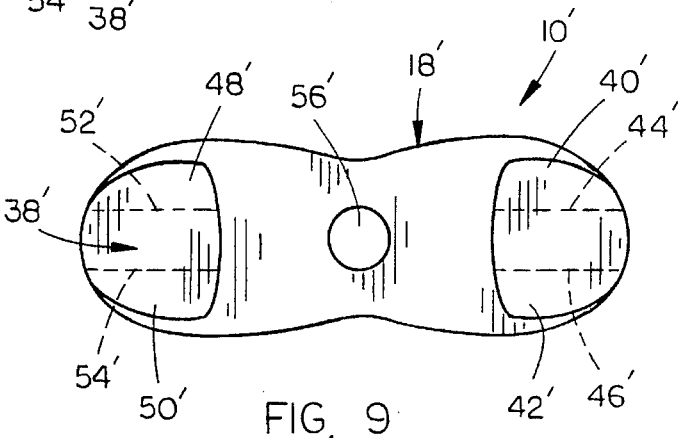
FIG. 9 is a rear elevational view of the embodiment shown in FIG. 7.

In use, it is recommended that the second embodiment of the jaw exerciser 10', shown in FIGS. 7–10, be initially utilized by those with persons with weak oral muscles, or during periods of less strenuous activities. Exerciser 10' is bent to a generally inverted U-shape, as shown in FIG. 8, to follow the curvature of the teeth in the mouth. Exerciser 10' is then inserted into the mouth with the upper and lower teeth journaled between the plate 18' and the ridges 40', 42', 48' and 50', engaged on the upper and lower biting surfaces of bite pads 36' and 38'. Exerciser 10 should be pushed into the mouth until the front teeth contact the rearward surface 22' of plate 18'. The separation of the upper and lower teeth on bite pads 36' and 38' should position the heads of the condyles of the lower jaw forwardly in their respective sockets. This repositioning of the heads of the condyles appropriately seats the lower jaw relative to the upper jaw, such that repetitive exercise strengthens the oral muscles, including the lips, tongue, and masseter muscles. The act of clenching the teeth in normal common nonstrenuous activities, such as walking, driving, or merely standing up and sitting down will cause a strengthening of the oral muscles.

For more strenuous activities, the second embodiment of the exerciser 10' should be replaced with the first embodiment 10 should in FIG. 1–6. The tapered biting surfaces 44, 46, 52 and 54 hold the mouth open to a greater extent than the second embodiment 10'. The greater area of air hole 56 also supplies a greater amount of oxygen during strenuous exercise such as weight lifting, moving heavy objects, or the like.

Whereas the jaw exerciser of the present invention has been shown and described in connection with the preferred embodiments thereof, many modifications, substitutions and additions may be made which are within the intended broad scope of the appended claims.

I claim:

1. A jaw exercising apparatus, comprising:

an elongated substantially straight plate having forward and rearward surfaces, upper and lower edges, and right and left ends;

said plate being formed of a resilient, compressible and flexible material to permit curvature from the left end to the right end to form a generally U-shape with the bite pads oriented towards one another;

a first bite pad projecting rearwardly from the rearward surface of the plate, proximal the right end thereof, formed of a resilient compressible material;

a second bite pad projecting rearwardly from the rearward surface of the plate, proximal the left end thereof, separate and spaced apart from the first bite pad and formed of a resilient compressible material;

said first and second bite pads each including a rearward surface and upper and lower biting surfaces, the distance between the upper and lower biting surfaces of said bite pads being less than the distance between the upper and lower edges of the plate;

upper and lower ridges projecting upwardly and downwardly respectively along the rearward surface of each said bite pad, said upper and lower ridges being spaced apart and generally parallel to the plate;

said first bite pad having an outward end proximal the right end of the plate, and the upper and lower biting surfaces of the first bite pad diverting from one another as they extend from the outward end;

said second bite pad having an outward end proximal the left end of the plate, and the upper and lower biting surfaces of the second bite pad diverting from one another as they extend from the outward end; and an aperture formed through said plate intermediate the upper and lower edges and right and left ends, for air flow therethrough.

2. The apparatus of claim 1, wherein the material from which the plate and bite pads are formed is a silicone rubber.

3. The apparatus of claim 1, wherein said plate upper and lower edges each have an indentation formed therein extending towards one another, and located generally midway between the right and left ends.

* * * * *